United States Patent [19]

Anderson

[11] Patent Number: 5,002,268

[45] Date of Patent: Mar. 26, 1991

[54] SWIMMER RESISTANCE TRAINING DEVICE

[75] Inventor: Glenn A. Anderson, Des Moines, Iowa

[73] Assignee: Creative Athletic Products & Services, Inc., Des Moines, Iowa

[21] Appl. No.: 321,099

[22] Filed: Mar. 9, 1989

[51] Int. Cl.[5] ..... A63B 31/00; A63B 69/10

[52] U.S. Cl. ..... 272/71; 272/130; 434/254

[58] Field of Search ..... 272/71, 116, 143, 93; 434/254; 441/55; D21/236, 237, 239

[56] References Cited

U.S. PATENT DOCUMENTS

| | | | |
|---|---|---|---|
| 3,142,485 | 7/1964 | Jacobsen | 272/57 |
| 3,424,133 | 1/1969 | Brady | 272/71 X |
| 3,517,930 | 6/1970 | Jacobsen | 272/71 |
| 3,584,870 | 6/1971 | Garst | 272/57 R |
| 3,786,526 | 1/1974 | Ausseil | 272/71 X |
| 4,074,904 | 2/1978 | Arcidiacono | 272/116 |
| 4,521,011 | 6/1985 | Solloway | 272/116 |
| 4,565,369 | 1/1986 | Bedgood | 272/130 |
| 4,721,300 | 1/1988 | Guzman | 272/71 X |
| 4,819,951 | 4/1989 | Solloway | 272/130 X |

*Primary Examiner*—Stephen R. Crow

*Attorney, Agent, or Firm*—Zarley, McKee, Thomte, Voorhees & Sease

[57] ABSTRACT

A swimming resistance training device of one-piece construction is provided which is L-shaped. One leg member includes aligned openings through which a belt extends for selectively positioning the device on the swimmer. Multiple devices may be placed on the belt. The other leg member which extends into the water includes a concave outer edge for matingly conforming to the swimmer's body during flip turns. Oppositely disposed forwardly extending laterally flared out wing portions are provided on the second leg member to funnel the water into the device to increase the resistance to forward movement.

16 Claims, 2 Drawing Sheets

SWIMMER RESISTANCE TRAINING DEVICE

BACKGROUND OF THE INVENTION

Time spent during swimming workout can be more productive if the resistance to the swimmer's forward movement in the water can be increased for purposes of the workout only. Increasing the drag on the swimmer is believed will reduce the amount of time required by the swimmer during the workout in preparation for a competitive event or for conditioning in general.

Complicated multipiece devices have been the subject of prior U.S. Pat. Nos. 3,142,485; 3,517,930; and 3,584,870. What is needed, however, is an inexpensive, simple to manufacture one-piece device that is easily attached or removed from the swimmer. The device should be comfortable to wear particularly on flip turns. The device should have a shape which would conform to the swimmer's body.

SUMMARY OF THE INVENTION

The drag device of this invention is of a one-piece construction made from sheet plastic material. It is L-shaped with two leg portions one of which has a series of aligned openings through which the belt extends for positioning the device on the swimmer. The other leg portion extends away from the swimmer's body and functions as a paddle in the water thereby resisting the forward movement of the swimmer through the water. The outer edge of the second leg member is concave to conform to the swimmer's body when the swimmer makes a flip turn. This significantly enhances the comfort of the device on the swimmer swimming laps.

The amount of resistance may be increased by the addition of integral wing portions at opposite ends of the second leg member. These wing portions extend forwardly and outwardly in the water to capture water against the device thereby further increasing the drag.

DESCRIPTION OF THE PREFERRED EMBODIMENT

Figure 1:
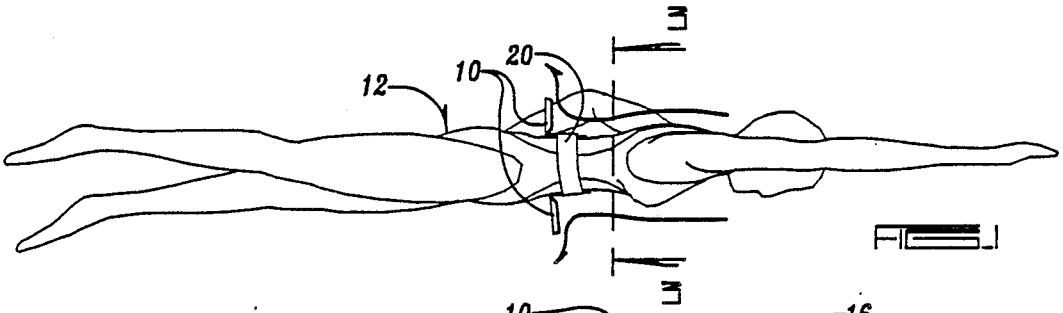
FIG. 1 is a side elevational view of a swimmer wearing the resistance training device of this invention.
Figure 2:
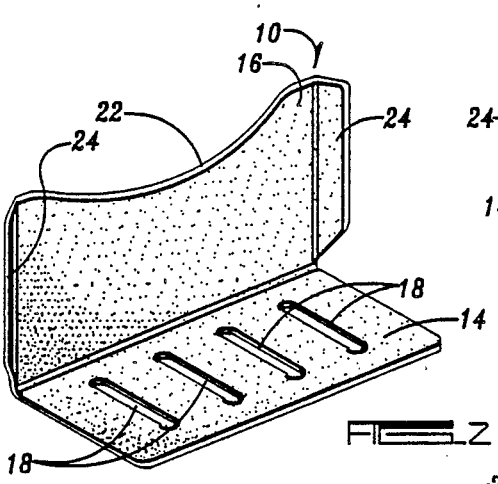
FIG. 2 is a perspective view thereof.
Figure 4:
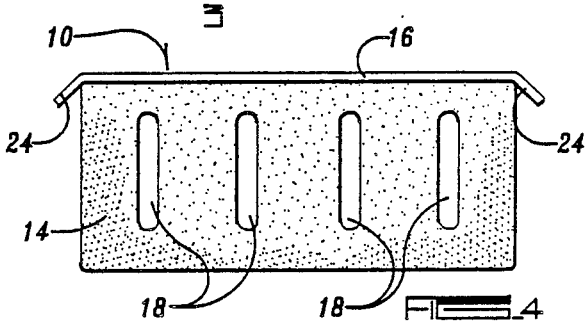
FIG. 4 is a top plan view of the device of FIG. 2.
Figure 5:
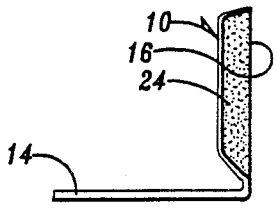
FIG. 5 is a right end elevational view as seen in FIG. 4.

The swimming resistance training device of this invention is referred to generally in FIG. 2 by the reference numeral 10 and is shown in FIG. 1 being used by a swimmer 12.

The resistance device 10 is of one-piece construction from plastic sheet material. It is L-shaped and includes a first leg portion 14 extending at right angles to the second leg portion 16. Leg portion 14 has a series of aligned openings 18 through which a belt 20 extends for holding the device 10 on the swimmer as seen in FIG. 1. The flat leg portion 14 is pressed tightly against the swimmer's body by the belt 20 and includes enough area to prevent it from rotating in response to water impacting on the second leg member 16. The belt has a sufficient width equal to the length of the openings 18 to hold the device 10 firmly against the swimmer's body.

Figure 7:
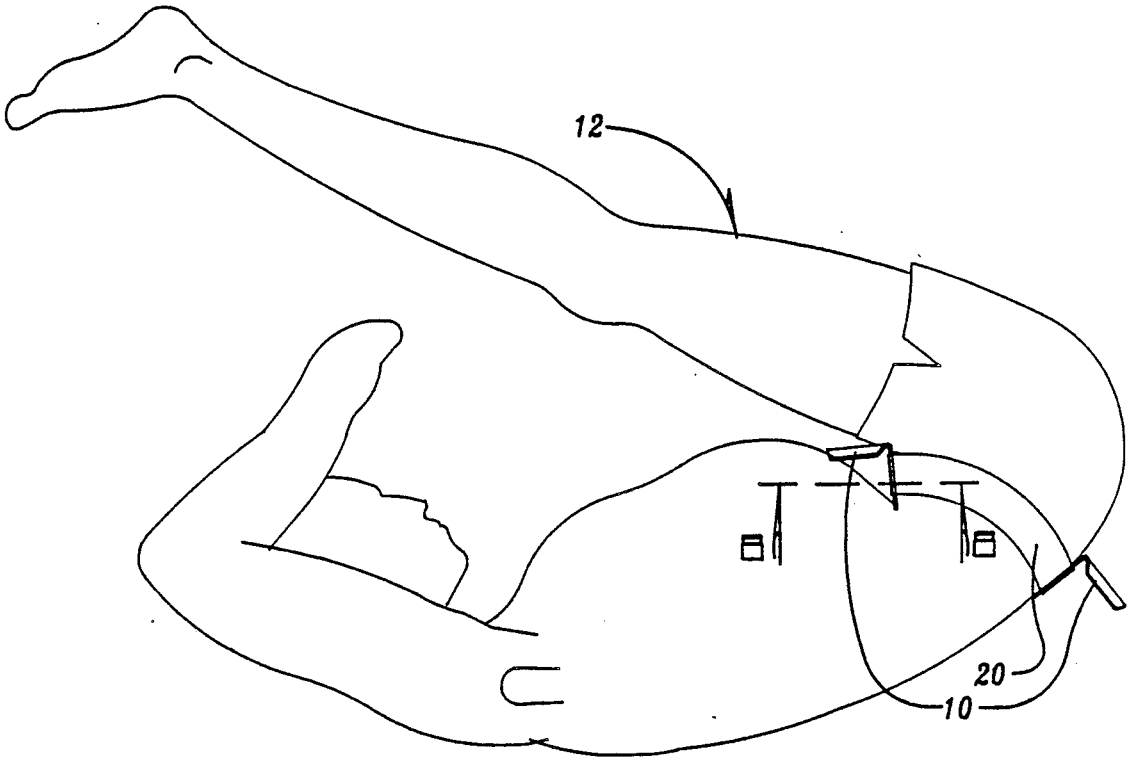
FIG. 7 is a view similar to FIG. 1 showing the device in use during a flip turn.
Figure 8:
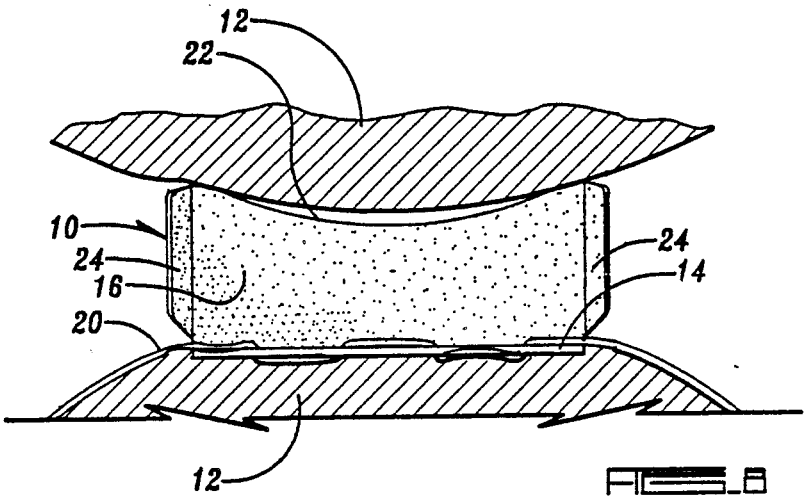
FIG. 8 is a cross sectional view taken along line 8—8 in FIG. 7.

The leg member 16 has a concave outer edge 22 designed to matingly conform to the swimmer's body during flip turns as seen in FIG. 7. This shape makes the device comfortable to wear during the many repetitive flip turns of the swimmer during a competitive workout. The swimmer in FIG. 7 has a larger upper body than that of the swimmer in FIG. 1 and thus when a flip turn is made the concave outer edge 22 matingly engages the convex upper body portion of the swimmer due to the device 10 rotating about the longitudinal axis of the belt 20.

The opposite ends of the leg members 16 include forwardly extending laterally outwardly flaring wing portions 24 which serve to funnel the water into the center area of the leg member 16 and hold it there to further increase the resistance to forward movement through the water.

Figure 6:
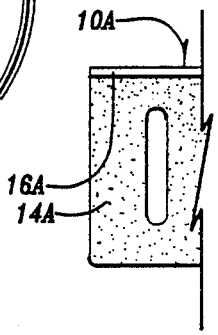
FIG. 6 is a fragmentary view similar to FIG. 4 but showing an alternate embodiment without the wing portions.

While the preferred embodiment includes the wing portions 24, an alternate embodiment 10A in FIG. 6 includes a first leg member 14A and a second leg member 16A which omits the wing portions.

Figure 3:
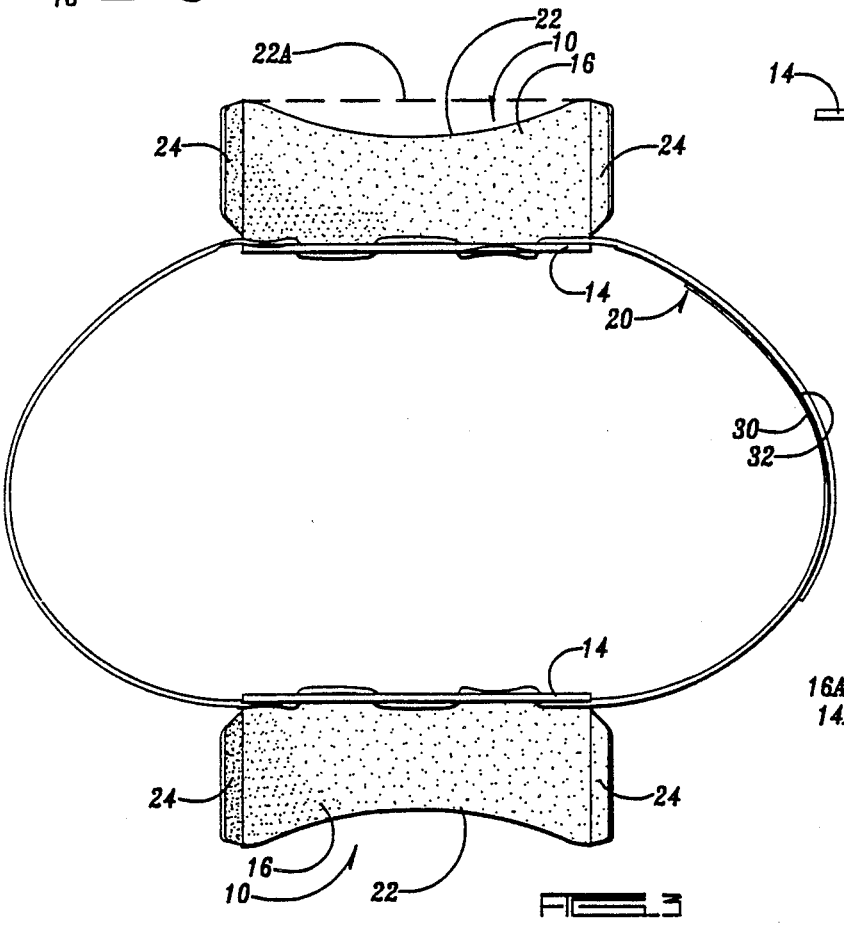
FIG. 3 is a cross sectional view taken along the line 3—3 in FIG. 1 showing two training devices being worn, one on the front of the swimmer and one on the backside.

Also it is preferred that the legs 16 include the concave forward edge 22 but as indicated by the dash line 22A in FIG. 3 the outer edge may be straight. This will be comfortable to the slim and trim swimmer during flip turns.

In use it is seen that the resistance training device 10 is mounted on the belt 20 by threading it through the openings 18 and then through use of a VELCRO (fastening tape) fastener, interconnecting opposite belt ends 30 and 32. The belt is comfortably positioned on the swimmer 12. One or two resistance training devices 10 may be mounted on the belt 20 depending on how much drag is desired. As seen when two devices are used, one is on the front side and one is on the backside of the swimmer.

What is claimed is:

1. A swimmer resistance training device for increasing the resistance of a swimmer's body to movement through the water comprising:

a belt encircling a swimmer's body at the waist;

a one piece L-shaped member having leg portions extending at a right angle to each other with one leg merging into the other leg;

one of said leg portions being substantially flat and secured to said belt and pressed by the belt flat against the swimmer's body; and the other of said leg portions being substantially flat and adapted to extend laterally across and perpendicularly away from the swimmer's body into the water to increase the resistance to movement through the water, said flat other leg portion having an outer concave longitudinal edge matingly engaging the swimmer's body when making a flip turn.

2. The structure of claim 1 wherein said one leg has a series of spaced apart aligned openings through which said belt adjustably extends for selectively positioning said L-shaped member on the swimmer's body.

3. The structure of claim 1 wherein said flat other leg portion is in a plane and has oppositely disposed integral wing portions extending substantially perpendicularly to said plane of said other leg portion, and forwardly in the direction of the swimmer's movement in the water to draw water in against the other leg portion between said wing portions to further increase resistance to movement through the water.

4. The structure of claim 2 wherein said flat other leg portion is in a plane and has oppositely disposed integral wing portions extending substantially perpendicularly to said plane of said other leg portion, and forwardly in the direction of the swimmer's movement in the water to draw water in against the other leg portions between said wing portions to further increase resistance to movement through the water.

5. A swimmer resistance training device for increasing the resistance of a swimmer's body to movement through the water comprising:

a belt encircling a swimmer's body at the waist;

a one piece only L-shaped member having leg portions extending at a right angle to each other with one leg merging into the other leg;

one of said leg portions being elongated and substantially flat and secured to said belt with its longitudinal axis extending laterally across the body at the waist and said one leg portion being pressed by the belt flat against the swimmer's body;

said one leg having a series of longitudinally spaced apart aligned openings through which said belt adjustably extends for selectively positioning said L-shaped member on the swimmer's body; and the other of said leg portions being elongated with a length greater than its width and substantially flat and adapted to extend with its longitudinal axis laterally across and its width perpendicularly away from the swimmer's body into the water to increase the resistance to movement through the water, said other leg portion having an outer concave longitudinal edge matingly engaging the swimmer's body when making a flip turn.

6. The structure of claim 5 wherein said flat other leg portion is in a plane and has oppositely disposed integral wing portions extending substantially perpendicularly to said plane of said other leg portion, and forwardly in the direction of the swimmer's movement int eh water to draw water in against the other leg portions between said wing portions to further increase resistance to movement through the water.

7. The structure of claim 5 wherein said flat other leg portion has oppositely disposed integral wing portions extending substantially perpendicularly to said plane of said other leg portion forwardly int he direction of the swimmer's movement in the water to draw water in against the other leg portions between said wing portions to further increase resistance to movement through the water.

8. A swimmer resistance training device for increasing the resistance of a swimmer's body to movement through the water comprising:

a belt encircling a swimmer's body at the waist;

a one piece L-shaped member having leg portions extending at a right angle to each other with one leg merging onto the other leg;

one of said leg portions being substantially flat and secured to said belt and pressed by the belt flat against the swimmer's body;

the other of said leg portions being substantially flat and adapted to extend laterally across and perpendicularly away from the swimmer's body into the water to increase the resistance to movement through the water, said other leg portion having an outer concave longitudinal edge matingly engaging the swimmer's body when making a flip turn; and said flat other leg portion being in a plane and having oppositely disposed integral wing portions extending substantially perpendicularly to said plane of said other leg portion, and forwardly in the direction of the swimmer's movement in the water to draw water in against the other leg portion between said wing portions to further increase resistance to movement through the water, said wing portions being at opposite ends of said other leg portion and making said other leg L-shaped at its opposite ends.

9. The structure of claim 8 wherein said one leg has a series of spaced aligned openings through which said belt adjustably extends for selectively positioning said L-shaped member on the swimmer's body.

10. The structure of claim 8 wherein said forwardly extending wing portions are further defined as also being flared laterally outwardly to increase the resistance to forward movement in the water.

11. The structure of claim 8 wherein a second L-shaped member similar to said first L-shaped member is provided on said belt with one being on the front and the other being on the back side of the swimmer's body at the waist to further increase drag.

12. The structure of claim 1 wherein a second L-shaped member similar to said first L-shaped member is provided on said belt with one being on the front and the other being on the back side of the swimmer's body at the waist to further increase drag.

13. The structure of claim 5 wherein a second L-shaped member similar to said first L-shaped member is provided on said belt with one being on the front and the other being on the back side of the swimmer's body at the waist to further increase drag.

14. A swimmer resistance training device for increasing the resistance of a swimmer's body to movement through the water comprising:

a belt for encircling the swimmer's body at the waist;

a one piece L-shaped member having leg portions extending at a right angle to each other with one leg merging into the other leg;

one of said leg portions being elongated and substantially flat and secured in longitudinal alignment with and to said belt with its longitudinal axis extending across the body at the waist and said one leg portion being adapted to be pressed by the belt flat against the swimmer's body;

said one leg having a series of spaced apart aligned openings through which said belt adjustably extends for selectively positioning said L-shaped member on the swimmer's body;

the other of said leg portions being substantially flat and adapted to extend laterally across and perpendicularly away from the swimmer's body into the water to increase the resistance to movement through the water, said flat other leg portion having an outer concave longitudinal edge adapted to matingly engage the swimmer's body when making a flip turn, and said flat other leg portion being in a plane and having oppositely disposed integral wing portions extending substantially perpendicularly to said plane of said other leg portion, and forwardly in the direction of the swimmer's movement in the water to draw water in against the other leg portion between said wing portions to further increase resistance to movement through the water.

15. The structure of claim 14 wherein a second L-shaped member similar to said first L-shaped member is provided on said belt with one being on the front and the other being on the back side of the swimmer's body at the waist to further increase drag.

16. The structure of claim 14 wherein each of said leg portions has substantially the same shape and area.

* * * * *